United States Patent [19]

Saito et al.

[11] 4,340,219

[45] Jul. 20, 1982

[54] TOY WTH INTERLOCKING OBJECT AND OBSTACLE

[76] Inventors: Isamu Saito; Hiroyuki Watanabe, both c/o 9-10 Tateishi, 7-Chome, Katsushika-Ku, Tokyo, Japan

[21] Appl. No.: 203,879

[22] Filed: Nov. 4, 1980

[30] Foreign Application Priority Data

Oct. 17, 1980 [JP] Japan ..... 55-147975

[51] Int. Cl.[3] ..... A63F 9/14

[52] U.S. Cl. ..... 273/1 GA

[58] Field of Search ..... 273/1 GA, 1 GB; 434/32, 434/63

[56] References Cited

U.S. PATENT DOCUMENTS

| | | | |
|---|---|---|---|
| 3,159,400 | 12/1964 | Brass et al. | 273/1 GA |
| 3,575,413 | 4/1971 | Furukawa et al. | 273/1 GA |
| 3,767,196 | 10/1973 | Nakamura | 273/1 GA |

FOREIGN PATENT DOCUMENTS

| | | | |
|---|---|---|---|
| 484664 | 9/1953 | Italy | 273/1 GA |
| 364203 | 10/1962 | Switzerland | 273/1 GA |
| 2011265 | 7/1979 | United Kingdom | 273/1 GA |

*Primary Examiner*—Paul E. Shapiro

*Attorney, Agent, or Firm*—K. H. Boswell; Edward D. O'Brian

[57] ABSTRACT

A toy has a housing in which is rotatably supported at least one disc having a plurality of object members on it. The object members are fixed to the disc and therefore movable with it. The toy includes a motor which drives the discs via a clutch. The clutch has two positions, one an engagement position wherein the disc is driven and the other a non-engagement position wherein the motor is no longer capable of driving the disc. A movable member is mounted on the housing and positioned in association with the disc. By moving over the surface of the disc, the movable member is capable of individually contacting each of the obstacles on the disc and upon such contact, the movable member is capable of interlocking with each of the obstacles to stop the rotation of the disc and shift the clutch into the non-engagement position where it remains until otherwise acted on. The toy includes a reset mechanism capable of disrupting the interlockment between the movable member and any of the obstacles allowing the clutch to shift from the non-engagement back to an engagement position and once again drive the disc.

12 Claims, 11 Drawing Figures

TOY WTH INTERLOCKING OBJECT AND OBSTACLE

BACKGROUND OF THE INVENTION

This invention is directed to a toy which includes a movable support member having a plurality of obstacles on it which are capable of being contacted by a movable member. The movable member is capable of interlocking with the obstacles and upon such interlockment disrupting a drive train which drives the disc. The disruptment of the drive train will be continued until a reset member is activated.

A plurality of devices of two general types are known which include rotating discs having obstacles located on their surface which represent vehicles of one type or another. The first type of device can generally be categorized as training devices such as driver training devices and the like. The second type are amusement devices of the general type wherein the operator of the device attempts to manipulate one vehicle down a pathway which includes a plurality of obstacles.

The driver training devices mentioned above are, of necessity, usually quite sophisticated. Since it is an object of these devices to teach or improve driving skills, the sophistication is necessary in order to simulate a certain degree of realistic situations which the operator of the device is likely to encounter. Of necessity then, these types of devices are complex and expensive.

The amusement type devices discussed above can generally be represented by a series of patents which include U.S. Pat. Nos. 2,108,726, 3,568,332, 3,565,413 and 3,767,196. All of these amusement devices include at least one rotating disc. When only one disc is used, the disc normally supports a plurality of obstacles which are repeatedly orbited past a vehicle. The devices are rendered more realistic by including more than one disc. This allows for the simulation of a complex obstacle course. Unfortunately, by incorporating more than one disc the known devices have been made unduly complicated. Their complexity has resulted in most of these devices requiring their own console which must rest on the floor because of its size. Concurrent with this, of course, is the cost factor. The size and cost therefore have precluded the general distribution of these devices and as such they are generally found in penny arcade type locations.

Both the above two classifications of devices have been found to be highly interesting to the operator of them. They require or they develop certain skills in the operator which not only are useful but have considerable amusement value. In view of this, it is considered that there exists a need for further devices of this type which require and/or develop these skills but which are miniaturized and therefore portable. Certain steps in this direction have been achieved in devices such as that found in application Ser. No. 971,646 assigned to the same assignee as this application. The device noted in that application is miniaturized with respect to previously known devices, however, it still is to large to be carried in the pocket or purse of the user of the device.

BRIEF SUMMARY OF THE INVENTION

It is a broad object of this invention to provide an amusement device of the type which provides for an obstacle course located on a rotating support means which in turn is located within a housing that is sufficiently small to be carried in a pocket or purse. It is a further object to provide such a device that is sufficiently sophisticated to require considerable operator skill but yet is so engineered that a minimum of parts are used. It is a further object to provide a device that is economical in manufacture and thus acceptable economically to a large segment of the consuming public.

These and other objects as will be evident from the remainder of this specification are achieved in a toy which comprises: a housing at least one support means rotatably mounted on said housing, said support means having a plurality of obstacle means located on it and movable with it; a drive means located on said housing, said drive means including a clutch means, said clutch means having an engagement position and a non-engagement position, said drive means capable of rotating said support means on said housing when said clutch is in said engagement position; a movable means movably mounted on said housing and positioned in association with said support means, said movable means capable of moving with respect to said support means, said movement of said movable means resulting in said movable means having the capacity to both avoid contacting each of said plurality of said obstacle means, and to contact each of said plurality of said obstacle means, when said movable means contacts any one of said plurality of said obstacle means said movable means capable of interlocking with said individual obstacle means contacted, said interlocking of said movable means with any of said plurality of said obstacle means stopping the rotation of said support means and causing said clutch means to shift from said engagement position to said non-engagement position and being maintained in said non-engagement position for as long as said movable means is interlocked with said obstacle means; reset means associated with said movable means and capable of disrupting said interlockment between said movable means and any of said plurality of said obstacle means and allowing said clutch means to shift from said non-engagement position to said engagement position.

The toy in the invention can be augmented by including a counter means connecting to the support means through that portion of the drive means which includes the clutch means. So incorporated, the counting means will be capable of counting the rotations of the support means when the clutch means is in the engagement position but would not count the rotations of the support means when the clutch means is in the non-engagement position.

Further, the toy can include a movable means being movable between a passive position wherein it is incapable of contacting and interlocking with the obstacle means and an active position where it can interlock with the obstacle means. While in the passive position, the counting means will be disengaged from the rotating means and would not count the rotations of it.

In the preferred embodiment of the invention, the support means includes at least one disc mounted within the housing for rotation thereon. The obstacle means is expressed as a plurality of indicia on one surface of the disc in conjunction with a plurality of locking members on the other surface of the disc. The movable means includes a sliding member and an arm. The arm and the sliding member move in concert such that an indicia located on the sliding member could be positioned with respect to one of the indicia on the disc and concurrently the arm is capable of interlocking with one of the locking members on the other surface of the disc.

BRIEF DESCRIPTION OF THE DRAWINGS

The invention described in this specification will be better understood when taken in conjunction with the drawings wherein.

Figures 1, 10:
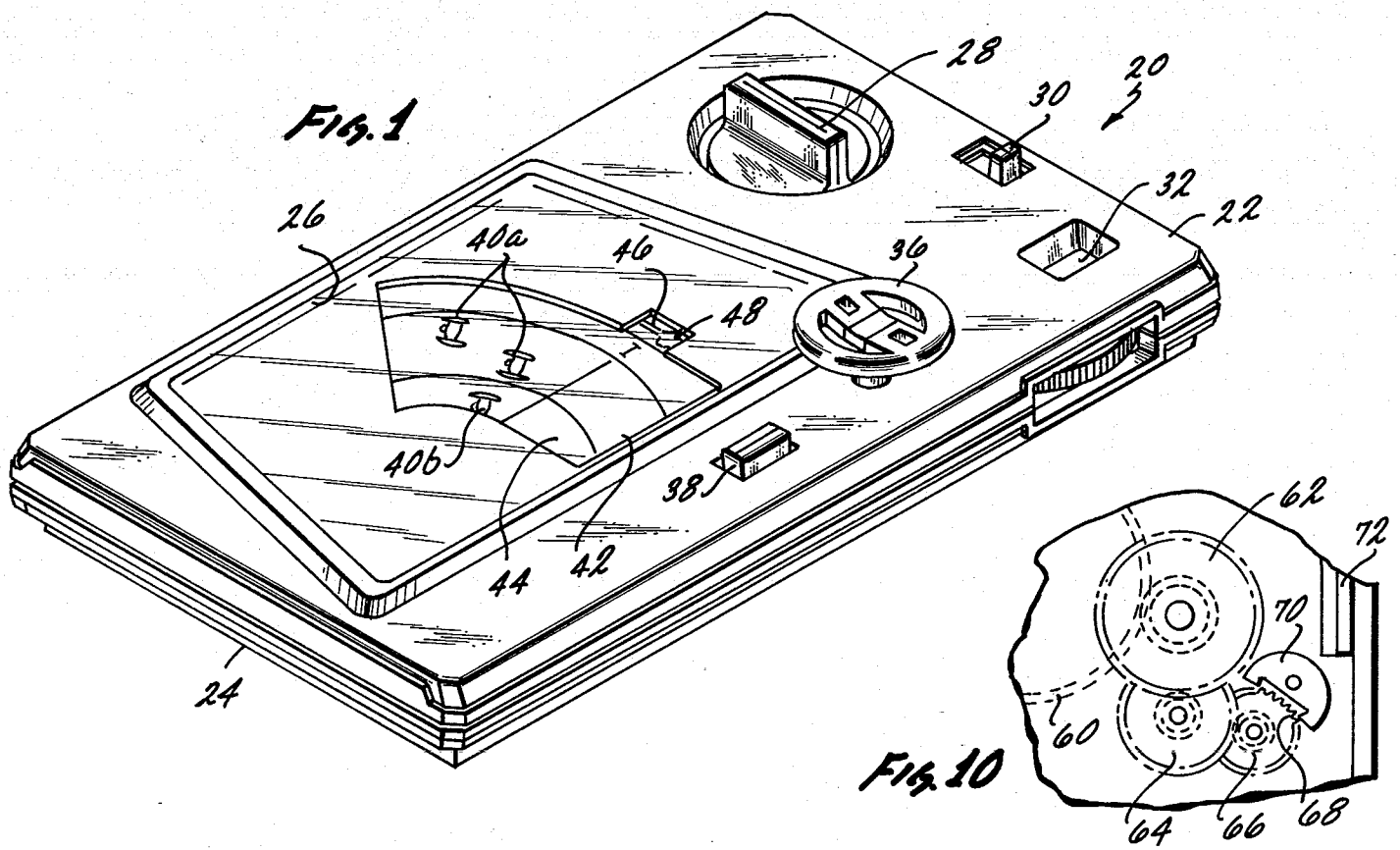
FIG. 1 is an isometric view of the complete toy as it will be used by its operator.
FIG. 10 is an enlarged view of certain of the components located on the right hand side of FIG. 2.
Figure 5:
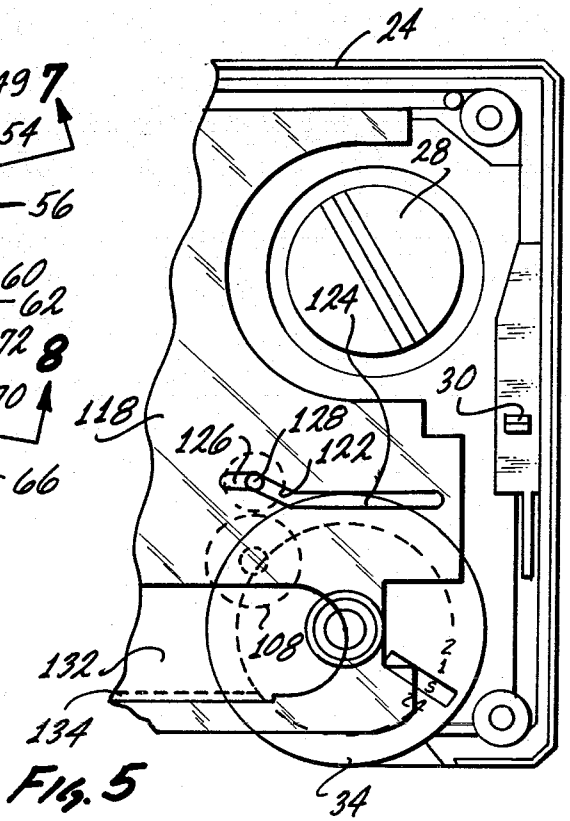
FIG. 5 is a top plan view of those components of FIG. 4 which are located on the right hand side of FIG. 4, these components, however, are shown in a different spacial relationship of than seen in FIG. 4.

The invention described in this specification and shown in the drawings utilizes certain principles and/or concepts as are set forth in the claims appended to this specification. Those skilled in the toy arts will realize that these principles and/or concepts are capable of being utilized in a number of embodiments different from the exact embodiments herein described. For this reason, this invention is to be construed as being limited by the claims and is not to be construed as to being only limited to the illustrative embodiment.

DETAILED DESCRIPTION

The toy 20 of the invention has an upper housing 22 and a lower housing 24. A large window 26 occupies a considerable amount of the upper housing 22. To the right of the window 26 is wind up knob 28. Along the right edge of the toy 20 is off and on button 30. Below button 30 is a small window 32 wherein a portion of the top surface of counting wheel 34 is exposed. A segment of the counting wheel 34 is exposed along the front edge of the toy 20 for reset purposes. Below the window 26 near its right hand bottom corner is steering wheel 36 and to the left of the steering wheel 36 is reset button 38.

Viewable inside of window 26 is a plurality of indicia collectively numbered by numerals 40-*a* and 40-*b*. Indicia 40-*b* are located on the upper surface of disc 42 and indicia 40-*b* are located on the upper surface of disc 44.

The toy operates as follows. Wind up knob 28 is rotated clockwise to energize a spring motor (identified later). The counting wheel 34 is set to zero by rotating the exposed portion until the numeral 0, located on its upper surface, is viewable through the small window 32. The off/on button 30 is then pushed to the on position. If indicator object 46 is located within the small notch 48 within window 26 the two discs 42 and 44 are started rotating counterclockwise but at different speeds. This causes the indicia 40-*a* and 40-*b* to rotate in a clockwise direction within the window 26. By manipulating the steering wheel 36 the operator of the toy can cause the indicator object 46 to move to the left out of the notch 48. Once over the surfaces of the discs 42 and 44, the operator of the toy attempts to negotiate the indicator object 46 in and out between the indicia 40 as they rotate. As long as the operator successfully avoids all of the indicia 40, the counting wheel 34 counts the rotations of the discs 42 and 44. As these rotations are counted, they are expressed by the individual indicia located on the counting wheel 34 which is exposed through the small window 32.

If the operator of the toy is unsuccessful in negotiating past one of the indicia 40 and, in fact, the indicator object 46 and one of the indicia 40 overlie each other there is an interlocking of certain mechanisms as hereinafter explained. This interlocking stops the rotation of the discs 42 and 44. Concurrent with cessation of rotation of the discs 42 and 44, the counting wheel 34 stops and the indicator object 46 becomes locked with respect to its position with one of the indicia 40 and resists movement in response to turning of the steering wheel 36. The internal motor, however, still is running winding down the force imparted to it by the winding of winding knob 28.

To free the indicator object 46 from the indicia 40 with which it is interlocked, the reset button 38 must be pushed. This automatically causes the indicator object 46 to move to the right and once again be located within the notch 48. At this time, the interlocking mechanism within the interior of the toy is disrupted and the discs 42 and 44 again begin to rotate. The operator of the toy is now free to once again move the indicator object 46 by rotating the steering wheel 36. After the discs 42 and 44 have rotated through a certain amount of degrees of rotation, as a penalty for having had to push the reset button 38, the counting wheel 34 once again starts counting the rotation of the discs 42 and 44.

Figure 2:
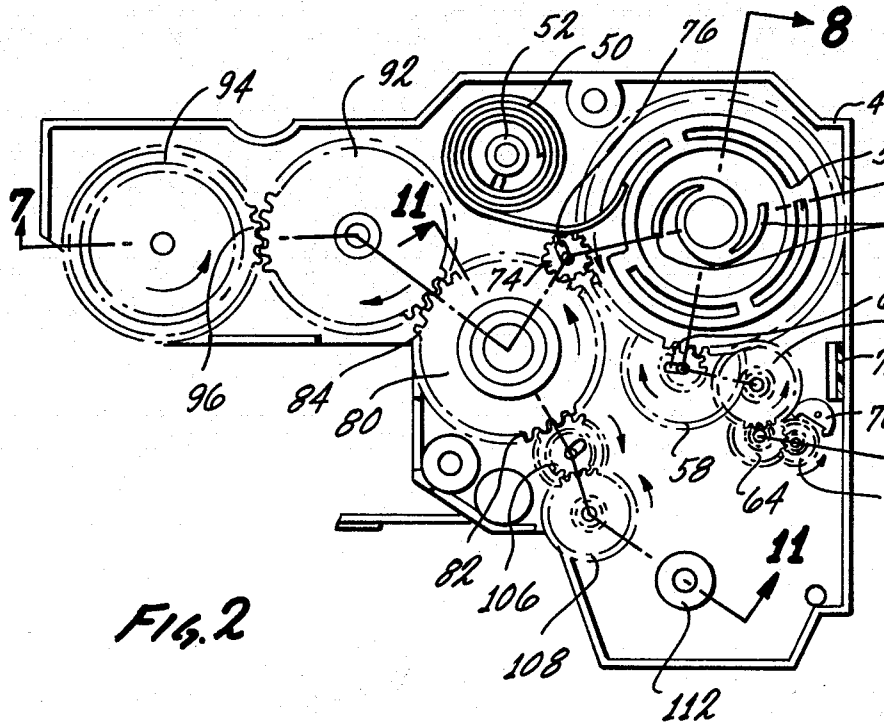
FIG. 2 is a top plan view of certain of the working components located within an interior housing of the toy of FIG. 1.

The drive mechanism of the toy 20 is shown in plan view in FIG. 2 and in side elevational views in FIGS. 7, 8, 9 and 11. The drive mechanism is located within a drive mechanism housing 49 which fits within the interior of the upper and lower housings 22 and 24. For the sake of brevity of this specification, none of the axles or bosses on which the gears of the drive mechanism are mounted on will be described or numbered. The appropriate axles or bosses are appropriately placed or mounted within the drive mechanism housing 49.

Within the interior of housing 49 a spiral spring 50 is fixed to and winds around an upstanding boss 52. The other end of the spring is attached to wind up wheel 54. When winding knob 28 is rotated clockwise the spiral spring 52 is wound about winding wheel 54. Two spring arms collectively identified by the numeral 56 project upwardly from the center of winding wheel 54 and engage the bottom of wind up knob 28. Because of their spiral nature, they are capable of transferring clockwise motion from the wind up knob 28 to the wind up wheel 54 but are incapable of transferring counterclockwise motion from the knob 28 to the wheel 54. The spiral spring 52 further serves to maintain the wind up knob 28 position in upper housing 22.

Figure 8:
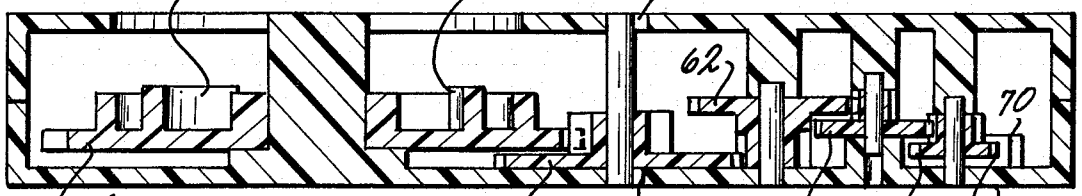
FIG. 8 is a side elevational view in partial section about the line 8—8 of FIG. 2.
Figure 9:
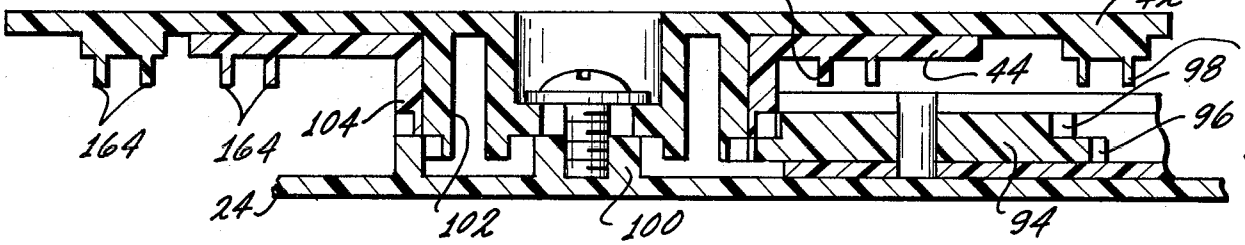
FIG. 9 is a side elevational view in partial section about the line 9—9 of FIG. 4.

Referring specifically to FIGS. 2, 8 and 10 located next to and engaging with wind up wheel 54, is a swing gear 58. This swing gear 58 is appropriately mounted on an axle allowing it to slide to the left in slots 60 when the spiral spring 20 is being wound around winding wheel 54. When it slides to the left it disengages with winding wheel 54 and no rotary motion of winding wheel 54 is transferred to it. However, when winding wheel 54 turns counterclockwise during operation of the toy, swing gear 58 is driven to the right in slot 60 which meshes it with the winding wheel 54. Swing gear 58 is a composite gear having a set of pinion teeth and a set of spur teeth neither of which are separately numbered. It is the pinion teeth which engage the winding wheel 54. The spur teeth engage gear 62 which also has a set of pinion and spur teeth not separately numbered. Gear 62 engages gear 64 which also has both pinion and spur teeth not separately numbered and it in turn engages gear 66 which has a set of pinion teeth, not numbered, and a set of engagement teeth 68.

Located in association with gear 66 is an engagement member 70 which is pivotally mounted to the housing 49 such that it oscillates back and forth as gear 66 rotates. The oscillation of engagement member 70 is governed by frictional forces. Ultimately, the speed of counterclockwise rotation of winding wheel 54 is governed by the interaction of the engagement member 70 with the engagement teeth 68. This serves to limit the maximum speed of counterclockwise rotation of winding wheel 54 under the influence of spiral spring 50. Projecting downwardly from off/on button 30 is a tab 72 which is positioned to engage with and prevent oscillation of engagement member 70 when off/on button 30 is in the off position. Tab 72 does not interact with engagement member 70 when the button is in the on position however. The interaction of tab 72 with the member 70 therefore serves as the off and on control for the counterclockwise rotation of winding wheel 54.

Figure 7:
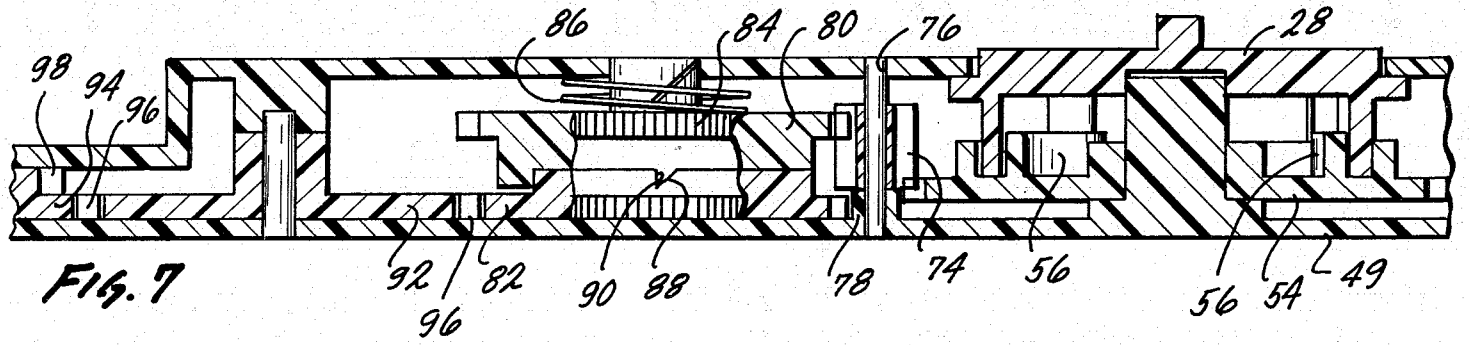
FIG. 7 is a side elevational view in partial section about the line 7—7 of FIG. 2.

To the left of winding wheel 54, as seen in FIG. 2 and in FIG. 7, there is a second swing gear 74. As with swing gear 58, swing gear 74 disengages with winding wheel 54 on clockwise rotation but engages with winding wheel 54 on counterclockwise rotation. This is accomplished by movement of swing gear 74 in slot 76. As seen in FIG. 7, located at the bottom of swing gear 74 is a bushing 78. The bushing 78 locates the swing gear 74 upwardly from the inner surface of housing 49. This is necessary because to the left of swing gear 74 is clutch 80 which is composed of a lower clutch gear 82 and an upper clutch gear 84. Both of these clutch gears 82 and 84 have a set of spur teeth around their circumference. Because of the presence of bushing 78 on the bottom of swing gear 74, only the teeth located on upper gear 84 are capable of meshing with and being rotated by swing gear 74. Lower gear 82 is completely independent from direct engagement with swing gear 74.

A compression spring 86 is located above upper clutch gear 84 and biases the upper clutch gear 84 downward toward lower clutch gear 82. Upper clutch gear 84 has two wedge like projections 88 spaced 180° apart, one of which can be seen in FIG. 7, which projects down toward and are capable of engaging in wedge shaped holes 90 in lower clutch gear 84. The wedge projections 88 can be considered as re-entrant gears. It can be seen that when the projections 88 are located within the holes 90 the frictional fit between them will transfer rotation from the upper gear 84 to rotation of the lower gear 82. If, however, for some reason as hereinafter explained, lower gear 82 is prevented from rotation, upper gear 84 can still rotate (that is in a clockwise direction as seen in FIG. 2) because of the wedge shape of the projections 88. The shape of the projections 88 will cause them to be lifted out of the holes 90 against the bias of the spring 86. The projections 88 will then ride along the upper surface of lower gear 82 until the upper gear 84 has rotated 180° at which time the projections 88 will again be aligned with the holes 90 allowing upper gear 84 to descend. If the lower gear 88 is still locked in position, the upper gear 84 will again be raised against the bias of spring 86 in the same way. If, however, the lower gear 82 is now free to rotate, as hereinafter explained, when the projections 88 descend into the holes 90 once again clockwise rotation of the upper gear 84 will be transferred to the lower gear 82.

To the right of the clutch 80 is spur gear 92. Spur gear 92 engages with the lower clutch gear 82 and transfers motion therefrom. To the right of spur gear 92 is gear 92. Gear 94 has a first set of spur teeth 96 of a first diameter and a second set of spur teeth 98 of a second diameter. The teeth 96 engage gear 92 and are rotated by it.

Referring now to FIGS. 2 and 8, discs 42 and 44 are concentrically located about upstanding boss 100. Disc 42 is in fact journalled about this boss. Disc 42 has a skirt 102 extending downwardly from its lower surface which is fitted with appropriate gear teeth which mesh with and are rotated by spur teeth 96 on gear 94. Disc 44 is journalled about skirt 102 of disc 42 and it has a skirt 104 projecting downwardly from its lower surface and has gear teeth located around it which mesh with and are rotated by spur teeth 98 of gear 94. Thus, both disc 42 and 44 are driven by gear 94, however, they are driven at different rates of rotation because of the differences in diameters of the spur teeth 96 and 98 and the skirts 102 and 104.

As will be hereinafter explained more fully, either of disc 42 or 44 are capable of being locked in position and thus no longer free to rotate. Because both of them engage gear 94, if one of them is fixed with respect to rotation the other is also and gear 94 is as well. By stopping one of the discs 42 or 44, in essence, the gear train composed of these discs, gear 94, gear 92 and lower clutch gear 82 is stopped. It is evident then that whenever one of the discs 42 or 44 are stopped while the winding wheel 54 is rotated counterclockwise, the clutch 80 will be activated causing the upper clutch gear 84 to lift free of and rotate independently of lower clutch gear 82.

To the bottom and to the right of the clutch 80 is a swing gear 106 which engages and is rotated by lower clutch gear 82. The swing gear 86 has a set of spur teeth, not separately identified or numbered, which engage with the lower clutch gear 82 and a set of pinion teeth, not separately identified and numbered, which engage with and rotate a set of spur teeth, not separately identified and numbered, located on gear 108. A set of pinion teeth, not separately identified and numbered, on gear 108 engage with and rotate a large gear 110 which is held above the bottom surface of lower housing 24 by a collar 112 integrally formed with the gear. Located directly over gear 110 is the counting wheel 34. Located around collar 112 are two spiral arms 114 and 116 integrally formed with gear 110. They project downwardly from the bias gear 110 against the lower surface of counting wheel 34. The spiral arms 116 allow for frictional engagement of gear 110 with counting wheel 34 such that the counting wheel 34 rotates with respect to rotation of gear 110 but can be independently rotated by engaging the edge portion which projects out of the upper housing 22 as viewed in FIG. 1. The presence of plate 114 and spiral arms 116 therefore allow the counting wheel 34 to be repositioned at the beginning of each time the toy 20 is started while also allowing rotation of the counting wheel 34 to be affected by the gear train encompassing lower clutch gear 82, swing gear 106, gear 108 and gear 110.

Located beneath the upper housing 22 over the surfaces of discs 42 and 44 and drive housing 49 is a sliding plate 118. Plate 118 is made of a transparent material having the indicator object 46 painted thereon. The longitudinally extending side edges of plate 118 are curved over and form runners for the plate 118 to slide back and forth to the left and right as viewed in FIG. 4. A tension spring 120 attaching at one end to plate 118 and at the other end to lower housing 24 biases the plate 118 to the right as viewed in FIG. 4. An elongated cutout 122 having a first section 124 and a second section 126 which are parallel to each other but not co-linear is located in the surface of plate 118.

Figure 3:
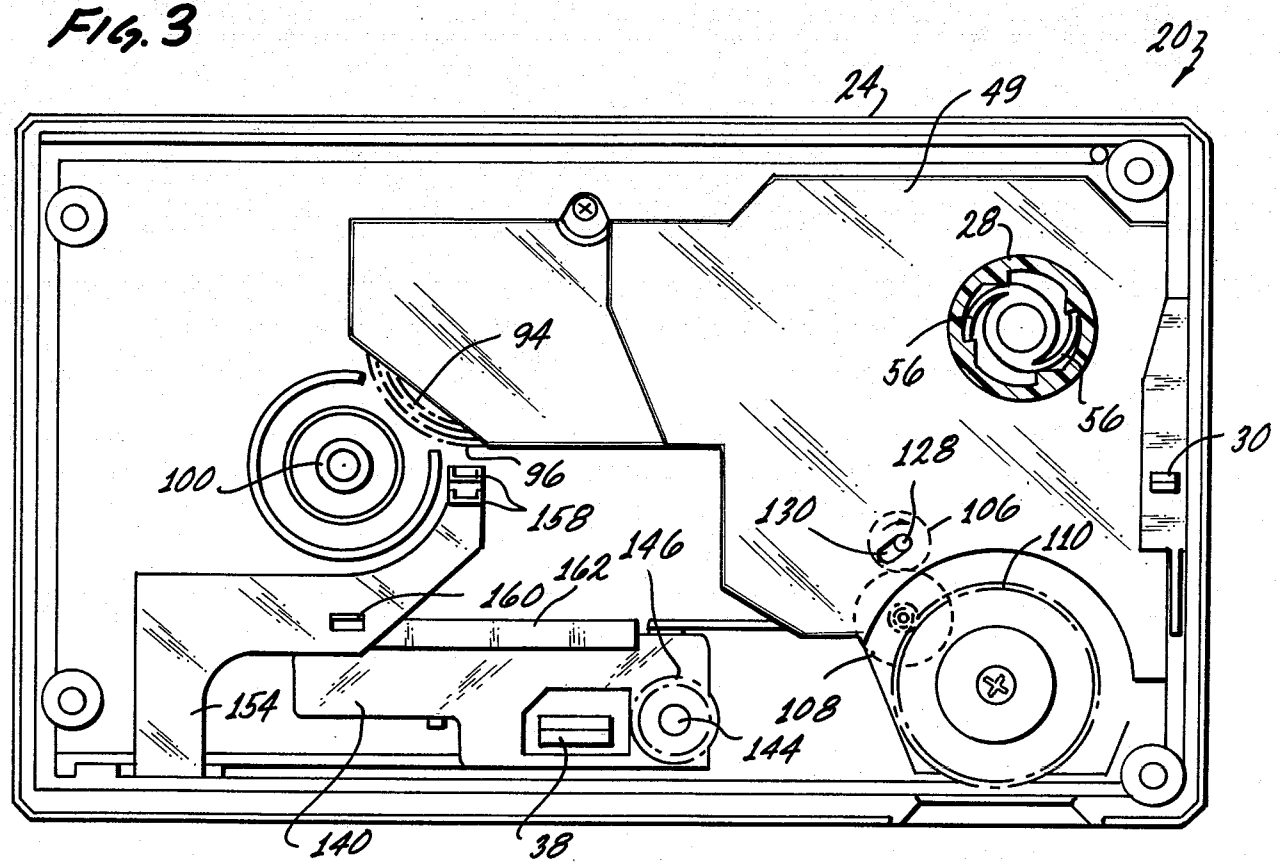
FIG. 3 is a top plan view in partial section of certain of the interior components which overlay those seen in FIG. 2.
Figure 4:
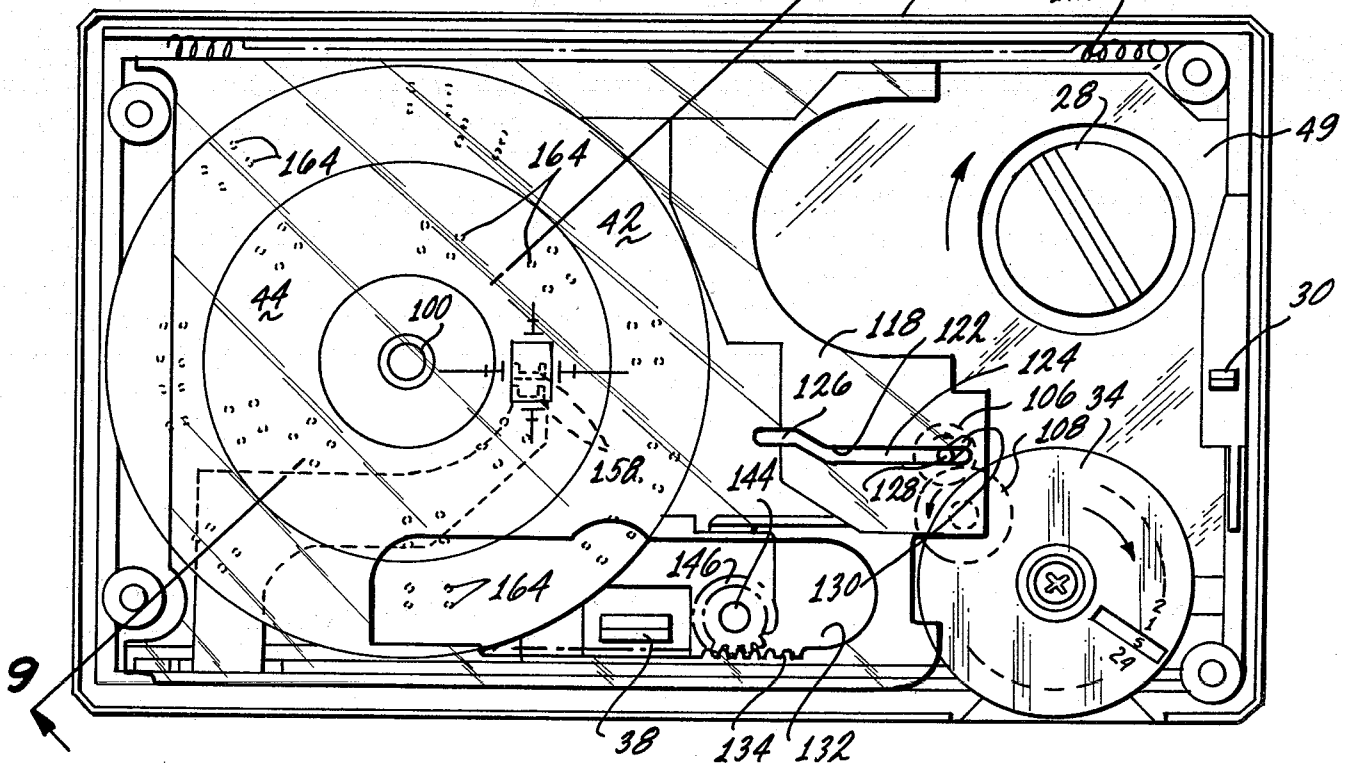
FIG. 4 is a top plan view of certain of the interior components which overlay those of FIG. 3 including some of those which are exposed on the outside of the toy and are also seen in FIG. 1.

The axle 128 on which swing gear 106 is mounted projects into and through the cutout 122. The position of this axle 128 within slots 130 formed in drive mechanism housing 49 is therefore governed by the location of plate 118. When plate 118 is located to the left as depicted in FIG. 4 the axle 128 is located in the first section 124 of the cutout 122. This positions the axle 128 downwardly and to the left in slot 130. In this position swing gear 106 is engaged with both lower clutch gear 82 and gear 108 and is capable of transmitting rotation of gear 82 to gear 108. When the plate 118 is slid all the way to the right the axle 128 is located in the second section 126 of cutout 122. This drives the axle 128 upwardly and to the right such that it is located within the slots 130 in the position depicted in FIG. 3. This disengages the swing gear 106 from gear 108 and disrupts transfer of rotation from clutch gear 82 to gear 108.

When plate 118 is located in its righthand most position the indicator object 46 is positioned within the notch 48. Thus, any time the indicator object 46 is in the notch 48 the counting wheel 34 is disengaged from the lower clutch gear 82 and therefore does not rotate or count revolutions of the discs 42 and 44.

A large elongated slot 132 is formed along the bottom edge of plate 118. The lower edge of this slot, as seen in FIG. 4, has a gear rack 134 located thereon. The reset button 38 projects up through the slot 132. A hollow boss 136 projects from the inside surface of lower housing 24. A compression spring 138 is located within the boss 136. A reset member 140 has a boss 142 formed in its surface which fits over and slides upon boss 136. This spring 138 biases the reset member 140 upwardly. The reset button 138 is formed with and projects upwardly from the top of boss 142. Downward motion of the reset member 140 against the bias of the spring 138 is therefore indirect consequence of movement of reset button 38.

To the right of boss 142 is a smaller boss 144 on which pinion 146 is pivotally mounted. When reset member 140 is at the limit of its upward travel under the influence of spring 138 pinion 146 projects through slot 132 and engages gear rack 134. When reset member 140 descends upon depressing reset button 38 pinion 146 is depressed below the surface of plate 118 and thus slides out of slot 132 and is no longer engaged with gear rack 134. Pinion 146, however, is always engaged with spur gear 148 which is attached to shaft 150. Also attaching to shaft 150 is steering wheel 36 and as such spur gear 138 rotates with respect to rotation of steering wheel 36. When reset member 140 is at its upward limit of travel plate 118 can therefore be made to shift right and left by turning steering wheel 36 because of the gear train composed of gears 148 and 144 and gear rack 134 which connects the steering wheel 36 to the plate 118. When the reset button 38 is depressed, however, this gear train is severed between the connection of gear 146 and gear rack 134 allowing plate 118 to freely slide to the right.

Figure 6:
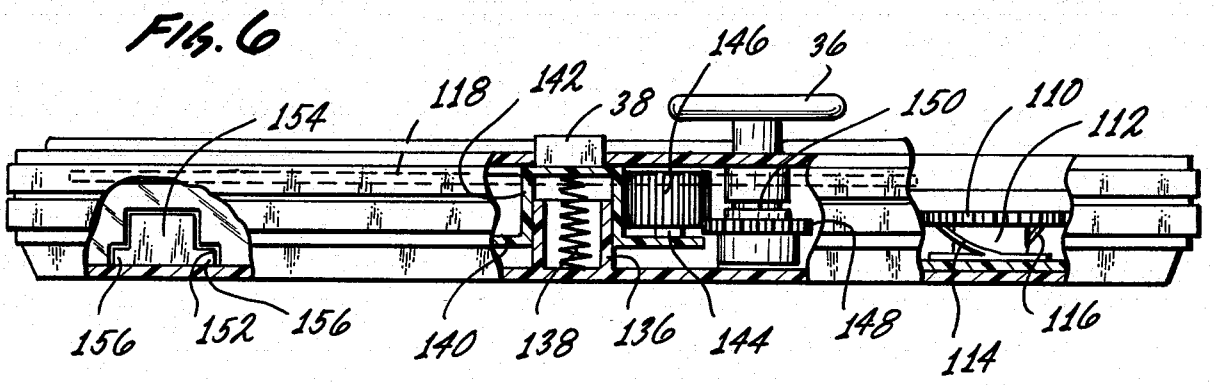
FIG. 6 is a side elevational view in partial section of certain of the components located along the leading edge of the toy as viewed in FIG. 1.
Figure 11:
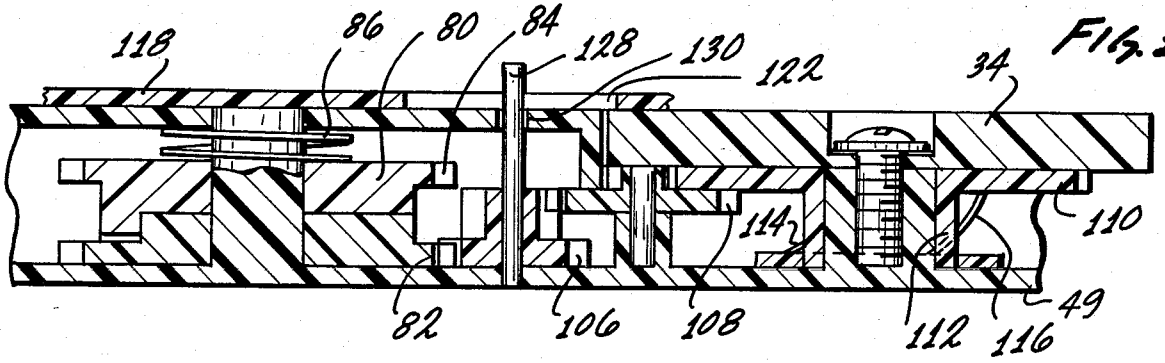
FIG. 11 is a side elevational view in partial section about the line 11—11 of FIG. 2.

As seen in FIG. 6 on the left hand side of the runner of plate 118 a cutout 152 is formed. An arm 154 has axles collectively identified by the numeral 156 which fit into this cutout. The arm 154 extends underneath the discs 42 and 44. The arm 154 has a grasping means shaped as two upstanding U-shaped projections collectively identified by the numeral 158 on its end opposite the end where axles 156 are located. In between the two ends of the arm 154 is a hook 160 (only the side edge of which can be seen in FIG. 3) which fits underneath edge 162 of reset member 140. Because of the arrangement between the hook 160 and the edge 162, the arm 154 will pivot about its axles 156 whenever reset member 140 descends by depressing reset button 38. This has the effect of lowering the projection 158 with respect to the bottom surfaces of discs 42 and 44.

The axles 156 of arm 154 are appropriately journalled in the bottom runner of plate 118 as noted above. This causes the arm 154 to move in concert with the plate 118. Thus, if the plate 118 is moved left and right by turning the steering wheel 36, as noted above, the arm 154 mimics its motion. The projections 158 are directly located below the indicator object 46 painted on the surface of plate 118.

Projecting from the bottom of the discs 42 and 44 are a plurality of obstacle pegs collectively identified by the numeral 164. These are located in sets of four in an array about the two discs 42 and 44 as best seen in FIG. 4. As the two discs 42 and 44 rotate clockwise under the influence of the winding wheel 54, as herebefore explained, it is possible to engage at least one of the pegs 164 of one of the sets into one of the projections 158. Each one of the sets of pegs 164 are positioned directly below one of the indicia 40 painted on the surface of disc 42 or 44. Whenever the indicator object 46 is located in line with one of the indicia 40, therefore, one of the pegs 164 of a set will be positioned to engage with one of the projections 158. If this happens, then the discs 42 and 44 will be prevented from clockwise rotation. If the pegs 164 interlock with the projection 158 the locking action imparted to the discs 42 and 44 ultimately causes the upper clutch gear 84 to move upwardly from the lower clutch gear 82. When this happens, rotation via bottom clutch gear 82 and swing gear 106 is no longer transferred to the counting wheel 34.

When the reset button 38 is depressed after such an interlocking as discussed in the preceding paragraph, the interaction between the lock 160 of the arm 154 and the edge 162 of the reset member 140 causes the arm 154 to swivel about its axles 156 which lowers the end of the arm 154 wherein the projections 158 are located to such an extent that the projections 158 descend below and disengage from the pegs 164 freeing the discs 42 and 44 to once again rotate. Concurrently, however, as noted previously, this also withdraws pinion 146 from its engagement with gear rack 134 allowing spring 120 to slide plate 118 to the right to locate the indicator object 46 within the notch 48 as well as concurrently sliding axle 128 such that the gear train between the lower clutch gear 82 and the counting wheel 34 is severed.

Depressing the reset button 38 after the discs 42 or 44 have been locked by the interaction of the pegs 164 and projections 158 serves to reposition the indicator object 46 in what can be called a passive position and also disengages the counting wheel 34. In the passive position the end of the arm 154 wherein the projections 158 are located is moved completely to the right of the pathway of any of the pegs 164 on the outer perimeter of disc 42 to a position where they cannot interact and lock with pegs 164. After resetting the mechanism, the plate 118 can once again be moved to the right putting the indicator object 46 into an active position wherein the projections 158 can once again engage with the pegs 164. This also positions axle 128 in the second section 126 of the cutout 122 allowing the counting wheel 34 to once again count the revolutions of the discs 42 and 44.

I claim:

1. A toy which comprises:

a housing at least one support means rotatably mounted on said housing, said support means having a plurality of obstacle means located on it and movable with it;

a drive means located on said housing, said drive means including a clutch means, said clutch means having an engagement position and a non-engagement position, said drive means capable of rotating said support means on said housing when said clutch is in said engagement position;

a movable means movably mounted on said housing and positioned in association with said support means, said movable means capable of moving with respect to said support means, said movement of said movable means resulting in said movable means having the capacity to both avoid contacting each of said plurality of said obstacle means, and to contact each of said plurality of said obstacles means, when said movable means contacts any one of said plurality of said obstacle means said movable means capable of interlocking with said individual obstacle means contacted, said interlocking of said movable means with any of said plurality of said obstacle means stopping the rotation of said support means and causing said clutch means to shift from said engagement position to said non-engagement position and being maintained in said non-engagement position for as long as said movable means is interlocked with said obstacle means;

reset means associated with said movable means and capable of disrupting said interlockment between said movable means and any of said plurality of said obstacle means and allowing said clutch means to shift from said non-engagement position to said engagement position.

2. The toy of claim 1 including counting means capable of connecting to said support means through a portion of said drive means which at least includes said clutch means, said counting means capable of counting the rotations of said support means when said clutch means is in said engagement position and capable of being disconnected from said support means when said clutch means is in said non-engagement position such that any rotations of said support means when said clutch is in said non-engagement position are not counted by said counting means.

3. The toy of claim 2 wherein said movable means moves between a passive position wherein said movable means is incapable of contacting and interlocking with any of said plurality of said obstacle means and an active position wherein said movable means is capable of avoiding or contacting and interlocking with each of said plurality of said obstacle means.

4. The toy of claim 3 wherein said reset means is capable, after disrupting said interlockment between said movable means and any of said plurality of said obstacle means, of moving said movable means to said passive position.

5. The toy of claim 4 wherein said counting means includes a counting means disengagement means, said counting means disengagement means disengaging said connection between said counting means and said portion of said drive means which includes said clutch means when said movable means is in said passive position.

6. The toy of claim 1 wherein said support means comprises at least one disc rotatably mounted on said housing, said disc having an upper circular surface and a lower circular surface;

said plurality of obstacle means includes a plurality of indicia located on the upper surface of said disc and a plurality of locking members equal in number to the plurality of the indicia located on the bottom surface of said disc such that one of said indicia is located on said upper surface of said disc in a position directly corresponding to the location of one of said locking members on the lower surface of said disc;

said movable means includes a sliding member and a sliding arm, said sliding member and said sliding arm operatively associated with each other such that they move in concert on said housing, said sliding member located above the upper surface of said disc and said sliding arm located below the lower surface of said disc, said arm including a grasping means located on one end thereof, said sliding member including an indicator located thereon, said indicator aligned with said grasping means such that when said indicator is located over one of said indicia on said upper surface of said disc said grasping member is located in association with one of said locking members on the bottom surface of said disc and is capable of interlocking with said locking member and preventing rotational movement of said disc.

7. The toy of claim 6 wherein said reset means includes a reset member operatively associated with said sliding arm, said reset member capable of depressing said sliding arm such that said grasping means is depressed with respect to said locking members disengaging said grasping means from any interlockment with any of said locking members.

8. The toy of claim 7 wherein said clutch means includes two clutch discs coaxially located one above the other and including a clutch engagement means capable of engaging said two clutch discs together such that rotation of one is propogated as rotation of the other, at least one of said clutch discs capable of axial movement with respect to the other of said clutch discs, said axial movement moving at least one of said discs to a position whereby said clutch engagement means is not capable of engaging said two clutch discs together and rotation of one is not propogated as rotation of the other.

9. The toy of claim 8 wherein said drive means includes a motor means and a gear train means, said two clutch discs each forming part of said gear train means, motion from said motor means being propogated along said gear train means when said clutch engagement means engages said two clutch discs together but not being propogated when said engagement means does not engage said two clutch discs together;

said support means includes a first and a second disc coaxially mounted, a portion of said first disc having an upper and lower surface lying in a plane, said second disc having an upper and lower surface lying in a plane that is co-planar with the plane of said first disc, each of said first and said second discs including a plurality of indicia on their upper surfaces and a plurality of locking members on their lower surfaces.

10. The toy of claim 9 including a speed governing means operatively associated with said motor means governing at least the speed of rotation of said gear train means.

11. The toy of claim 7 including counting means capable of connecting to said support means through a portion of said drive means which at least includes said clutch means, said counting means capable of counting the rotations of said support means when said clutch means is in said engagement position and capable of being disconnected from said support means when said clutch means is in said non-engagement position such that any rotations of said support means when said clutch is in said non-engagement position are not counted by said counting means;

said movable means moves between a passive position wherein said movable means is incapable of contacting and interlocking with any of said plurality of said obstacle means and an active position wherein said movable means is capable of avoiding or contacting and interlocking with each of said plurality of said obstacle means;

said reset means is capable, after disrupting said interlockment between said movable means and any of said plurality of said obstacle means, of moving said movable means to said passive position.

12. The toy of claim 11 wherein said counting means includes a counting means disengagement means, said counting means disengagement means disengaging said connection between said counting means and said portion of said drive means which includes said clutch means when said movable means is in said passive position.

* * * * *

UNITED STATES PATENT AND TRADEMARK OFFICE

CERTIFICATE OF CORRECTION

PATENT NO. : 4,340,219

DATED : JULY 20, 1982

INVENTOR(S) : SAITO ET AL.

It is certified that error appears in the above–identified patent and that said Letters Patent are hereby corrected as shown below:

Column 3, line 62, "40-b" should read --40-a--.

Column 6, line 21, "92" should read --94--.

Column 6, line 67, "the bias" should read --and bias--.

Signed and Sealed this

*Nineteenth* Day of *October 1982*

[SEAL]

*Attest:*

GERALD J. MOSSINGHOFF

*Attesting Officer*

*Commissioner of Patents and Trademarks*